US006306051B1

(12) United States Patent
Stockhamer

(10) Patent No.: US 6,306,051 B1
(45) Date of Patent: Oct. 23, 2001

(54) DEVICE FOR MAINTAINING PROJECTILE-TYPE GAME DART

(76) Inventor: Lee Stockhamer, 1788 Horton Rd., Mohegan Lake, NY (US) 10547

( * ) Notice: Subject to any disclaimer, the term of this patent is extended or adjusted under 35 U.S.C. 154(b) by 0 days.

(21) Appl. No.: 09/651,850

(22) Filed: Aug. 31, 2000

Related U.S. Application Data

(63) Continuation-in-part of application No. 09/481,244, filed on Jan. 11, 2000, now Pat. No. 6,220,977, which is a continuation of application No. 09/291,442, filed on Apr. 13, 1999, now Pat. No. 6,152,841, which is a continuation-in-part of application No. 08/837,542, filed on Apr. 21, 1997, now Pat. No. 5,921,874.

(51) Int. Cl.[7] ..... B26B 27/00; B26B 3/04

(52) U.S. Cl. ..... 473/569; 30/304; 81/53.2; 81/176.1; 81/488; 451/552

(58) Field of Search ..... 30/304, 305; 81/53.2, 81/176.1, 176.15, 176.2, 488; 451/552, 555, 558; 473/569

(56) References Cited

U.S. PATENT DOCUMENTS

| | | | |
|---|---|---|---|
| 1,360,765 | 11/1920 | Knowlton . | |
| 3,050,911 | 8/1962 | Brittingham . | |
| 3,270,368 | 9/1966 | Cook et al. . | |
| 3,735,542 | 5/1973 | Kocian . | |
| 4,001,982 | 1/1977 | Griffin et al. . | |
| 4,069,528 | 1/1978 | Newton et al. . | |
| 4,455,784 | 6/1984 | Gallo . | |
| 4,472,879 | 9/1984 | Sizemore | 30/304 |
| 4,635,406 | 1/1987 | Rumbaugh . | |
| 4,785,586 | 11/1988 | Kratfel . | |
| 4,974,273 | 12/1990 | Buttermore et al. . | |
| 5,068,954 | 12/1991 | Houska | 29/240 |
| 5,205,193 | 4/1993 | Wield | 81/176.15 |
| 5,921,874 | 7/1999 | Stockhamer | 473/569 |

FOREIGN PATENT DOCUMENTS

| | | | |
|---|---|---|---|
| 454132 | 12/1927 | (DE) | 30/304 |
| 407525 | 11/1946 | (IT) | 451/555 |

*Primary Examiner*—John A. Ricci
(74) *Attorney, Agent, or Firm*—Hoffman & Baron, LLP

(57) ABSTRACT

A first dart tool 110 having a hollow first housing 112. The first dart tool 110 has a flight straightener 114 securely attached to the first housing 112. The flight straightener 114 has a flight straightener top 114T which has a flight straightener top front 114TA having a flight straightener top front right corner 114TAR and a flight straightener top front left corner 114TAL. The flight straightener 114 further has a flight straightener bottom 114B which has a flight straightener bottom front 114BA having a flight straightener bottom front right corner 114BAR and a flight straightener bottom front left corner 114BAL. A first sharpener 116 is securely positioned within the first housing 112. An alternative embodiment of the dart tool includes a unique combination of flight straighteners, tip sharpener and wrench-type devices for removal of metal and plastic types of several sizes, as well as a device for removal of broken plastic shafts and tips. A housing is provided having a flight straightener, a tip sharpener, and an adjacent metal insert which includes a through hole which defines wrenches of several types and sizes for ready tip removal. A channel is provided in the housing to receive a shaft for removal. Positioned within the channel is a post which is insertable into an aperture of the shaft to rotationally fix the shaft for threaded removal. The post includes a plurality of sharp tips at the free end for gripping the surface of a broken shaft or tip for threaded removal. The unique collection of multi-type tools in a single unit permits the player to concentrate effectively while quickly maintaining the darts with a readily accessible combination of tools.

25 Claims, 13 Drawing Sheets

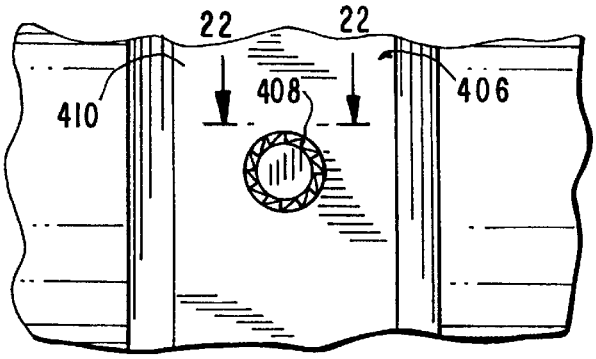
FIG. 21
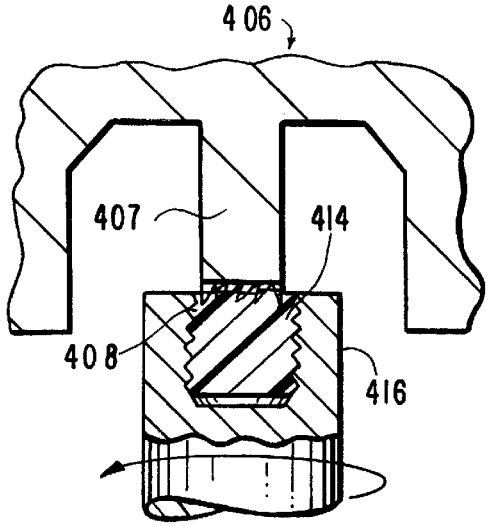
FIG. 23
FIG. 22
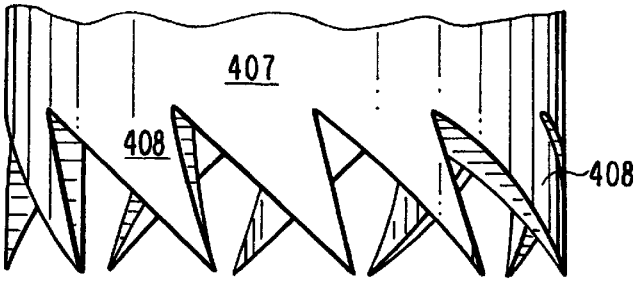
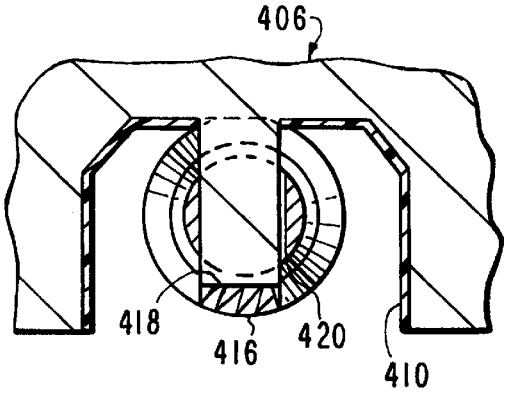
FIG. 25
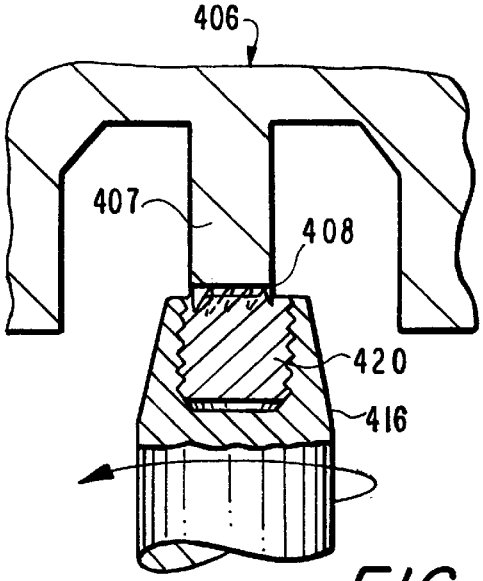
FIG. 24

DEVICE FOR MAINTAINING PROJECTILE-TYPE GAME DART

CROSS REFERENCE TO RELATED APPLICATIONS

This application is a continuation-in-part of application Ser. No. 09/481,244, filed Jan. 11, 2000, now U.S. Pat. No. 6,220,977, which is a continuation of application Ser. No. 09/291,442, filed Apr. 13, 1999, now U.S. Pat. No. 6,152, 841, which is a continuation-in-part of application Ser. No. 08/837,542, filed Apr. 21, 1997, now U.S. Pat. No. 5,921, 874, the disclosures of which are incorporated herein by reference and made a part of this disclosure.

BACKGROUND OF THE INVENTION

1. Field of the Invention

The present invention relates to the game of darts. More specifically, the present invention relates to a device for maintaining projectile-type darts in which various tools of different types and distinct functions are uniquely combined to facilitate quick and efficient maintenance of such darts under competitive conditions, including such functions as grooming of the fins or flights, tightening of the shaft, removal of the shaft when broken, sharpening of the tip when required, and removal of the tip when necessary.

2. Description of the Related Art

A game dart is essentially a hand thrown fin stabilized projectile which includes four major sections, including a sharpened tip at the distal end, a head, and a shaft at the proximal end, the shaft having fins made of feather-like materials, metallic foil, plastic or the like, supported thereon which act as aerodynamic stabilizers. The head may also be denoted the barrel. The fins in combination are referred to as a flight. The sharp tip is attached to the distal end of the head and the shaft is attached to the proximal end of the head.

While early darts actually used feather materials for construction of the flights, modem darts now primarily use various synthetic materials which have been proven to maintain a preselected aerodynamic shape and alignment. Typically, the flights are now made from mylar, metallic foil, and synthetic plastics of various types. Through use the flights generally sustain age which affects the aerodynamic performance of the darts resulting in reduced accuracy and consistency of flight. What is needed is a device which is capable of grooming the flights to restore and maintain the aerodynamic performance of the darts, while also having the capability to repair all sections of the darts in a relatively quick manner, without distracting the user, since the user is usually functioning under intense competitive conditions. In particular, a typical user of such darts requires heavy concentration on his or her own actions and score while remaining intent on the actions of the opposing side during their turn(s). Thus, a unique combination of tools in a single compact unit will permit the user to maintain the darts with minimum distraction from the game.

As noted, the dart projectiles themselves have a sharp point at the distal end of the tip. These sharpened points of the darts are typically made of a metallic material. These dart points become dull during use of the darts when they hit objects such as dividing wires (i.e. wires which divide numbered segments on a dart board), other darts, or bounce out onto a hard surface. In order to resharpen the dart tips to a sharp point a stone-type sharpening tool having an abrasive sharpening surface is commonly used.

Although the traditional-type darts with metallic tips are used with a bristle-type dart board, with the advent of electronics a new type of dart tip and board has emerged. There now exists an electronic dart board typically made of a plastic material and having a multiplicity of electronically sensitive apertures. These new dart boards contain electronic systems, so that the score of the game is automatically recorded and tallied when a dart enters an aperture in the board. Such boards are also made without the electronic features, whereby scores are manually tallied.

These new dart boards require the player to use special dart tips made of plastic, so as not to damage the board or the electronic circuitry in the board. The plastic dart tips are typically attached to the dart head by screwing a threaded portion of the dart tip into a correspondingly threaded aperture in the dart head. However, in order to securely attach the dart tips, the tips must be sufficiently tightened into the dart head.

The plastic dart tips typically have indentations on the proximal surface so that a wrench-type tool can be used to grip the tip to screw it into the dart head. Various types of wrench-type configurations may be used. The indentations on the surface of the plastic tips typically may have either a star-type configuration or a configuration having two or more flat surfaces. When two flat surfaces are used, they are generally parallel to each other. Other combinations of surfaces may include conventional wrench-type shapes including rectangular or hexagonal configurations or the like. In either instance, the wrench utilized for removal or tightening the tip portion will have a corresponding similar configuration, such as star-type or the like.

The star-type configuration is such that when viewed from the top of the tip, it appears that the indentations in the surface of the tip form a star-type pattern. The dart tip removal tool is typically generally slid over the distal end of the tip and fits over the proximal end portion of the tip, and has corresponding protrusions which engage the indentations on the tip, thus securely holding the tip in place. The wrench type configuration is such that when the tip is viewed from the front, there are two flat indentations in the proximal surface of the dart tip. Again, the tip removal tool for this configuration fits over the proximal end portion of the dart tip and has corresponding parallel surfaces which engage the parallel sides on the dart tip to hold the dart in place. Other wrench type configurations operate in a similar manner.

The plastic tips for the darts must be changed on a regular basis so that they function properly with the new electronic boards. Since the tips are made of plastic they are easily broken or deformed during normal use or by dropping onto a hard surface. Although, as described, there are tools for removing such tips, such tools are typically a thin sheet of metal and do not adequately hold the dart tip securely when loosening or tightening. Thus the indentations on the dart tips may become stripped and the threaded portions on the dart tips become damaged since the tips are not held securely in place while they are screwed into the dart head.

Numerous innovations for dart tools have been provided in the prior art that are adapted to be used. Even though these innovations may be suitable for the specific individual purposes to which they address, they would not be suitable for the purposes of the present invention as heretofore described.

SUMMARY OF THE INVENTION

The present invention is a hand held device having a double bladed tool which conditions the flights by removing or reducing nicks and notches which occur through use. The present invention has a handle attached to a plurality of blades extending radially outward from the handle. A recess is formed between the blades. The blades are positioned to accept the flights of the dart. In use, a flight is slid through a recess in the blades which are squeezed together by the user. This action removes or compresses a small portion of the flight which restores the flight to a flightworthy condition.

The types of problems encountered in the prior art are maintenance of game darts including; restoring aerodynamic surfaces of dart flights by removing nicks and notches in the flights, removing broken shafts and tightening shafts.

The present invention solves the problem of restoring aerodynamic surfaces of dart flights by removing or reducing nicks and notches in flights by reshaping the flight until the nicks and notches are removed or reduced.

The present invention solves the problem of removing broken shafts by providing a tool which engages the broken shaft end and permits turning the shaft so as to unscrew it from the head, or holding the shaft and turning the head. The tool has at least a pair of posts which are sharpened. Preferably, a plurality of sharpened posts (i.e. spikes) is provided, each having a slanted acute angular orientation toward the direction of unthreading of the broken shaft or tip. Such sharpened posts- or spikes- may be provided along the peripheral edge of a support post, or alternatively over the entire surface of the support post. The sharpened ends of the posts are inserted into the broken end of the shaft so as to pierce the relatively irregular broken surface of the shaft. The posts are recessed within the tool to permit safe pocket storage.

The present invention solves the problem of tightening shafts by providing a post which is inserted into a shaft hole and in cooperation with the tool provides leverage for tightening or loosening shafts.

Innovations within the prior art are rapidly being exploited as dart throwing increases in popularity.

The present invention fills a long felt need for a device which restores the aerodynamic properties of the flights.

In keeping with these objects, and with others which will become apparent hereinafter, one feature of the present invention resides, briefly stated, in a flight straightener.

When the dart tool is designed in accordance with the present invention, the flights are restored to a flight worthy aerodynamic condition.

Accordingly, it is an object of the present invention to provide a flight straightener having a flight straightener top.

In accordance with another feature of the present invention, the flight straightener has a flight straightener top and a flight straightener bottom.

Another feature of the present invention is that the flight straightener top has a flight straightener top front which has a flight straightener top front right corner and a flight straightener top front left corner.

Yet another feature of the present invention is that the flight straightener bottom has a flight straightener bottom front which has a flight straightener bottom front right corner and a flight straightener bottom left corner.

Still another feature of the present invention is that the first dart tool has a first housing which contains a first sharpener a first sharpener opening and a third sharpener.

Yet still another feature of the present invention is that the this sharpener has a third sharpener opening, and a third sharpener shaft connector remover.

Still yet another feature of the present invention is that a second dart tool has a second housing.

Another feature of the present invention is that the second housing has a second housing channel, second housing post, second sharpener, and a second sharpener opening.

Still yet another feature of the present invention is that a flight straightener top and flight straightener bottom, in an operable position, are parallel to the flight.

Another feature e present is that a flight straightener top and flight straightener bottom have peripheral edges which are not sharpened, functioning to permit safe use and pocket storage.

Still yet another feature of the present invention is that a flight straightener top flight straightener bottom do not require a shield to protect the user when the first dart tool (110) is stored and during use.

An alternative embodiment of the present invention is a dart tool for maintaining such projectile-type darts, each having a head portion, a tip portion and a shaft portion, the shaft portion having flight stabilizing devices supported thereon to form a flight. The present dart tool has the added feature of a tool for removing a dart tip portion that is threadedly attached in the head portion of the dart. The dart tool has a flight straightener which is attached to the housing. There is a top flight straightener and a bottom flight straightener each having a flat surface and a peripheral edge, which are squeezed together by a user while a dart flight is slid between the top and bottom, whereby the surface of the flight is smoothed and/or material is scraped therefrom. The dart tool has the added feature of having a wrench-type device for threadedly removing a tip portion from the head portion. One wrench-type device includes parallel flat surfaces to fix the position of the tip portion, and a second wrench-type device includes a star-type device for threadedly removing a star-type-tip portion from the head portion. Still another wrench-type device has parallel surfaces similar to the first mentioned wrench-type device, but is dimensioned to accommodate darts of lesser dimension. Each type of wrench is included in the dart tool. Furthermore, a dart shaft removal device is incorporated in the dart tool for tightening or loosening dart shafts and may also be used to remove broken portions of a dart shaft or dart tip, usually plastic, from the dart head.

An added feature of the dart tool is a dart shaft holder which is incorporated into the housing of the dart tool by which a dart shaft is held in place while the user tightens or loosens a dart head. Preferably, the dart shaft holder is a channel in the housing which cradles a dart shaft, and a post is securely attached within the channel and extends upwardly therefrom whereby the post is positioned in an aperture provided in the dart shaft to hold the dart shaft in the channel fixed from rotation. The channel may be optionally coated with a non-abrasive material such as plastic, leather, rubber, nylon and fabric cloth, so that the dart head will not be scratched by the surface of the housing.

In addition, there are multiple spikes protruding outward from the top of the post for gripping a broken shaft or broken tip broken at the level at the dart head. These spikes may be placed anywhere on the top of the post and are preferably angled in a direction opposite the threading direction of the shaft or tip to increase the grip the spikes have on a broken shaft or tip when in use. The spikes are preferably provided over the entire top surface of the free end of the post, but may also be provided along a peripheral edge of the post.

The dart tool of the present invention solves the problem of removing old or worn plastic dart tips from the dart head by providing a device for holding the tip securely to eliminate slippage and unwanted movement.

The dart tool of the present invention solves the problem of having to carry multiple separate tools to accomplish the task of removing various types of plastic dart tips, repair damaged flights, and sharpen steel tipped darts. The dart tool of the present invention conveniently combines a plurality of dart maintenance devices, applicable to darts of various types such as metal darts, plastic darts, etc. Because of its compact structure and its multiple functions, it can be readily incorporated into well known multi-function tools such as Swiss army-type knives or tools marketed under the registered trademark LEATHERMAN.

The novel features which are considered characteristic of the invention are set forth in the appended claims. The invention itself, however, both as to its construction and its method of operation, together with additional objects and advantages thereof, will be best understood from the following description of the specific embodiments when read and understood in connection with the accompanying drawings.

BRIEF DESCRIPTION OF THE DRAWINGS

Preferred embodiments of the invention are described hereinbelow with reference to the drawings, wherein;

FIG. 21 is a left side elevational view of the dart tool of FIG. 10, illustrating the dart shaft removing device of the invention;

FIG. 22 is an elevational view of the dart shaft removing device of FIG. 21, illustrating the angled pointed spikes adapted for pierced engagement of the broken shaft for removal purposes;

FIG. 23 is a cross-sectional view of the dart shaft removing device of FIGS. 21 and 22, illustrating removal of a remaining threaded portion of a plastic dart shaft which has been broken at the level of the dart head;

FIG. 24 is a cross-sectional view of a dart shaft removing device being used in a similar manner as shown in FIG. 23, illustrating removal of a threaded portion of a dart tip which has been broken at the level of the dart head; and FIG. 25 is a partial cross-sectional view of an embodiment of the dart shaft removal device for use with metal shafts, wherein the post is inserted into an aperture provided on the dart shaft for leveraged rotation of the threaded dart shaft from the dart head.

DESCRIPTION OF THE PREFERRED EMBODIMENT

Figure 1:
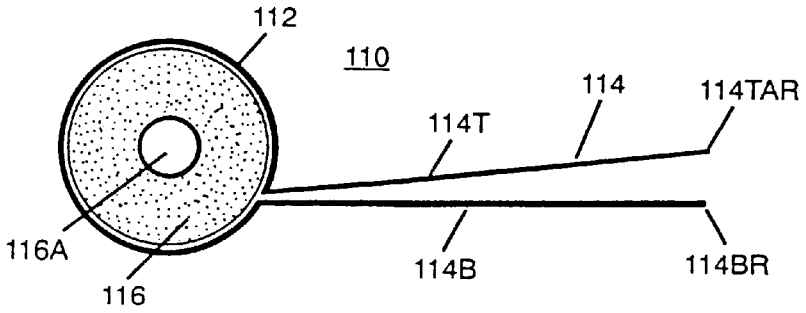
FIG. 1 is a side view of a first dart tool.
Figure 2:
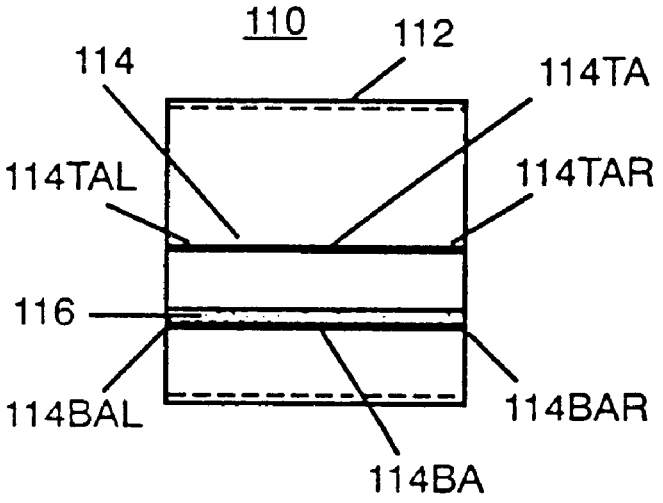
FIG. 2 is a front view of the dart tool shown in FIG. 1.

Firstly, reference is made to FIG. 1 which is a side view of a first dart tool 110 and FIG. 2 which is a front view of a first dart tool 110. The first dart tool 110 comprises a hollow first housing. The first dart tool 110 further comprises a flight straightener 114 which is securely attached at a rear end to the first housing 112. The first housing 112 and the flight straightener 114 are constructed from a material selected from a group consisting of metal, metal alloy, plastic, plastic composite, epoxy, fiberglass, and carbon-graphite.

Figure 7:
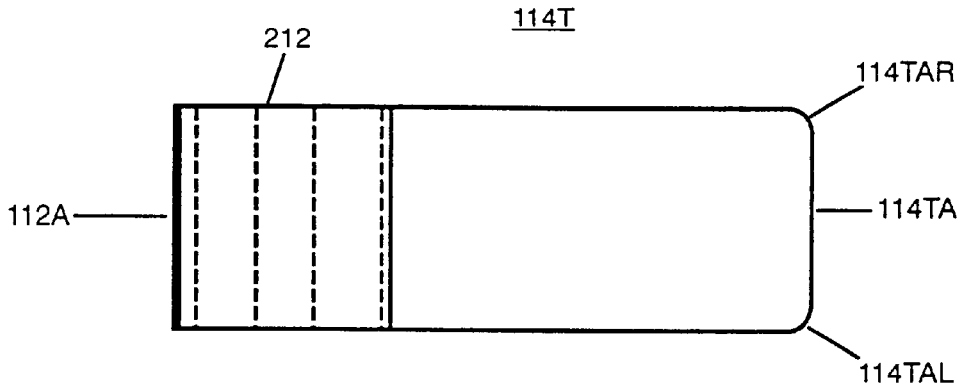
FIG. 7 is a top view of the dart tool shown in FIG.4.

The flight straightener 114 comprises a flight straightener top 114T which comprises a flight straightener top front 114TA having a flight straightener top front right corner 114TAR and a flight straightener top front left corner 114TAL. The flight straightener top front right corner 114TAR and the flight straightener top front left corner 114TAL and the flight straightener bottom front right corner 114BAR and the flight straightener bottom front left corner 114BAL are rounded as shown in FIG. 7 to prevent damage to the flight during use. The flight straightener 114 further comprises a flight straightener bottom 114B which comprises a flight straightener bottom front 114BA having a flight straightener bottom front right corner 114BAR and a flight straightener bottom front left corner 114BAL.

Figure 12:
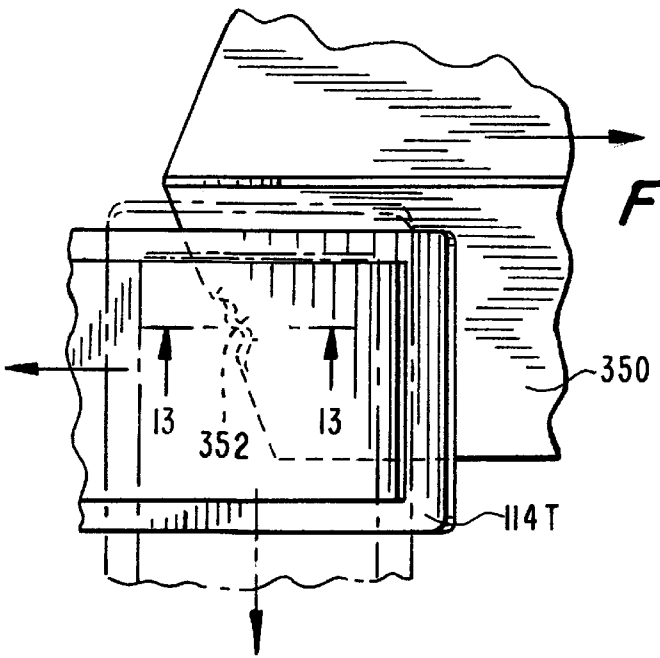
FIG. 12 is a plan view of the flight straightener device with a damaged flight positioned therein for repair.
Figure 13:
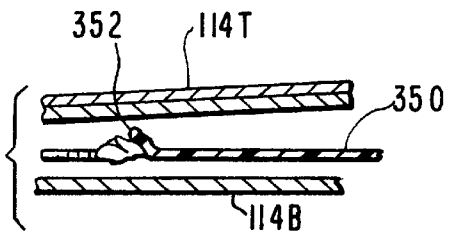
FIG. 13 is a cross sectional view taken along lines 13—13 of FIG. 12, illustrating a damaged portion of the flight shown in FIG. 12 prior to engagement by the flight straightener blade.
Figure 14:
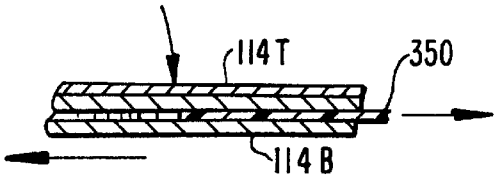
FIG. 14 is a cross-sectional view similar to FIG. 13 after engagement of the damaged flight by the flight straightener blade of the flight straightener device of FIG. 10.

A damaged flight is shown in FIG. 12 positioned between the flight straightener top 114T and flight straightener bottom 114B. FIG. 13 illustrates the damaged portion 352 of the flight between the flight straightener blades. In operation a flight 350, having at least one edge, is inserted between the flight straightener top 114T and flight straightener bottom 114B such that the flight straightener top 114T and the flight straightener bottom 114B straddles at least one edge of the flight. FIG. 14 shows how the user moves the first dart tool 110 generally parallel to at least one edge while squeezing the flight straightener bottom 114B and the flight straightener top 114T together. This motion alternatively smoothes and scrapes material from the surface of the flight.

Referring again to FIGS. 1 and 2, alternatively, the flight is inserted between the flight straightener top 114T and the flight straightener bottom 114B such that the flight straightener top 114T and the flight straightener bottom 114B are generally perpendicular to at least one edge of the flight. The user moves the first dart tool 110 generally perpendicularly and outwardly to at least one edge while squeezing the flight straightener bottom 114B and the flight straightener top 114T together. This motion smoothes the surface of the flight.

The center of the flight may be repaired in addition to the outer peripheral edge. The flight is inserted between the flight straightener top 114T and flight straightener bottom 114B. The flight straightener is brought toward the center of the flight where the top and bottom straighteners are en pressed together as shown in FIG. 14 The user then moves the tool along the length of the center portion of the flight that is damaged. This motion smoothes and flattens the center portion of the flight that is damaged.

This motion may result in filaments of flight material attached to at least one edge of the flight at one end of the opposite end and extending beyond at least one edge of the flight. These filaments can cause degradation of aerodynamic flight. The filaments are removed by inserting the filaments between the flight straightener top 114T and the flight straightener bottom 114B such that the flight straightener top 114T and the flight straightener bottom 114B are generally perpendicular to at least one edge. The insertion is stopped when the flight straighter top front 114TA and flight straightener bottom front 114BA are positioned at the inner end of the filament. When the user squeezes the flight straightener top 114T and the flight straightener bottom 114B together and pulls the first dart tool 110 generally perpendicularly and outwardly to at least one edge of the flight the filaments are removed.

The flight straightener top 114T and flight straightener bottom 114B have peripheral edges having a shape selected from a group consisting of not sharpened, rounded and square which functions to protect adjacent fins, a dart shaft, and the user.

The first dart tool 110 still further comprises a first sharpener 116 securely positioned within the first housing 112. The first sharpener 116 comprises a first sharpener opening 116A in which a user sharpens a dart point. The first sharpener 116 is constructed of a material selected from a group consisting of stone, diamond cutting material, cubic zirconium, stone composites, and composites.

Figure 3:
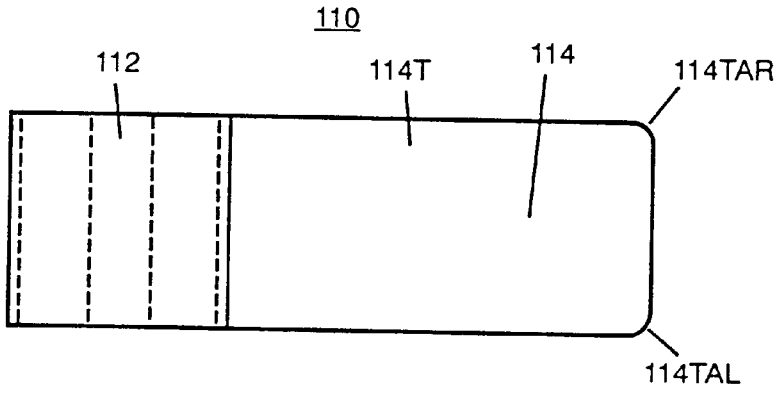
FIG. 3 is a top view of the dart tool shown in FIG. 1.

Secondly, reference is now made to FIG. 3 which is a top view of a first dart tool 110. The first dart tool 110 comprises a hollow first housing. The first dart tool 110 further comprises a flight straightener 114 which is securely attached at a rear distal end to the first housing 112.

The flight straightener 114 comprises a flight straightener top 114T which comprises a flight straightener top front 114TA having a flight straightener top front right corner 114TAR and a flight straightener top front left corner 114TAL.

Figure 4:
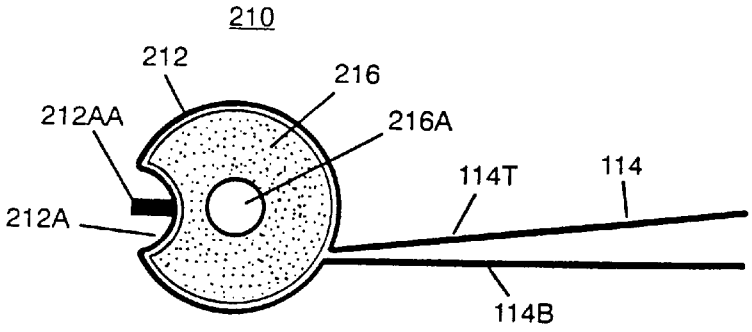
FIG. 4 is a side view of a second dart tool.
Figure 5:
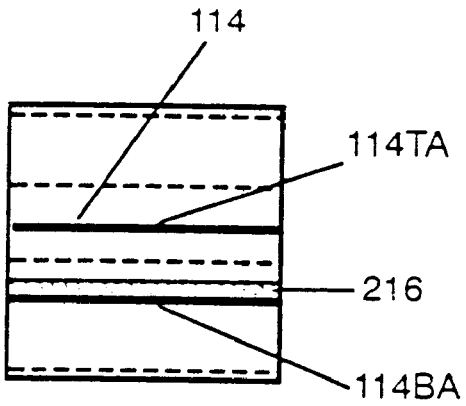
FIG. 5 is a front view of the second dart tool shown in FIG.4.
Figure 6:
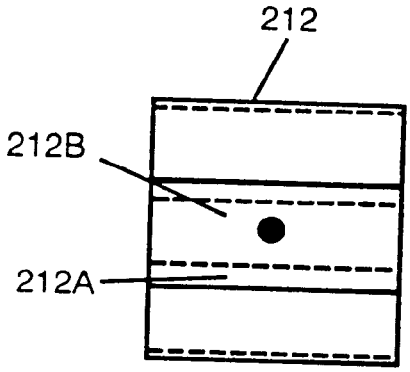
FIG. 6 is a rear view of the second dart tool shown in FIG.4.

Thirdly, referring to FIG. 4 which is a side view of a second dart tool 210, FIG. 5 which is a front view of the second dart tool 210, FIG. 6 which is a rear view of the second dart tool 210 and FIG. 7 which is a top view of the first dart tool 210 all together. The second dart tool 210 comprises a second housing 212 which comprises a second housing channel 212A functioning to cradle a dart shaft therein. A second housing post 212B is securely attached within the second housing channel 212A extending upwardly therefrom. The second housing post 212B is positioned in an opening in a dart shaft functioning to hold the dart shaft in place while a user tightens or loosens a dart head. A second sharpener 216 is positioned within the second housing 212. The second sharpener 216 comprises a second sharpener opening 216A. The second sharpener 216 is constructed from stone.

The second dart tool 210 further comprises a flight straightener 114 securely attached at a rear distal end to the second housing 212. The flight straightener 114 comprises a flight straightener top 114T which comprises a flight straightener top front 114TA having a flight straightener top front right corner 114TAR and a flight straightener top front left corner 114TAL, The flight straightener 114 further comprises a flight straightener bottom 114B which comprises a flight straightener bottom front 114BA having a flight straightener bottom front right corner 114BAR and a flight straightener bottom front left corner 114BAL. The flight straightener top front right corner 114TAR and the flight straightener top front left corner 114TAL and the flight straightener bottom front right corner 114BAR and the flight straightener bottom front left corner 114BAL are rounded functioning to prevent damage to the flight during use.

The second housing 212 and the flight straightener 114 are constructed from a material selected from a group consisting of metal, metal alloy, plastic, plastic composite, expoy, fiberglass, and carbon-graphite.

Figure 8:
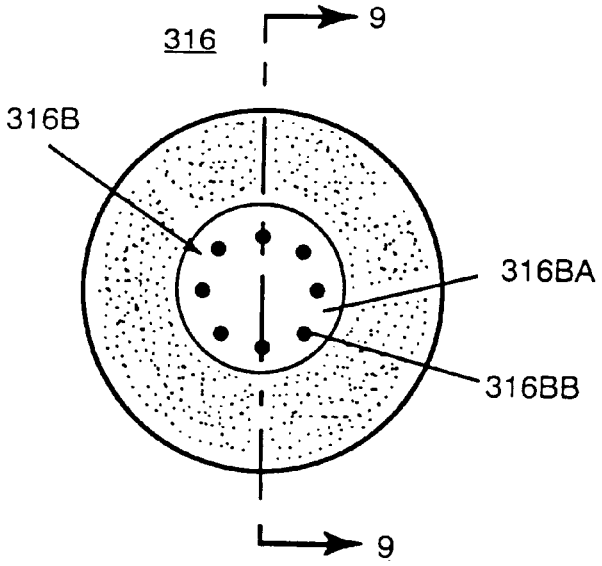
FIG. 8 is a top view of a third sharpener.
Figure 9:
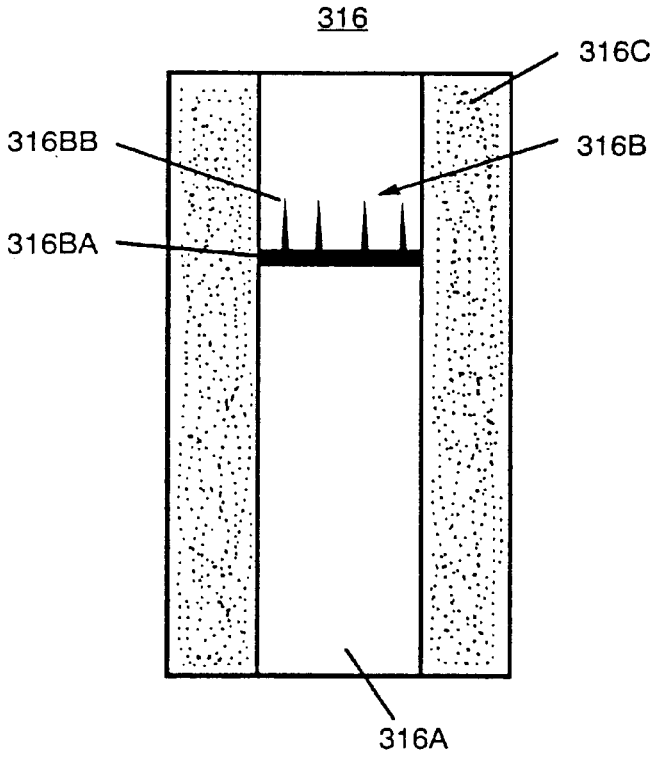
FIG. 9 is a cross-sectional view of the third sharpener shown in FIG.8, taken along lines 9—9 of FIG. 8.

Reference is now made to FIG. 8 which is a top view of a third sharpener 316 and FIG. 9 which is a cross sectional view of a third sharpener 316 along line 9—9. The third sharpener 316 comprises a cylindrical third sharpener opening 316A and a third sharpener shaft connector remover 316B positioned within the third sharper opening 316A. The third sharpener 316 is constructed from stone.

The third sharper shaft connector remover 316B comprises a third sharpener shaft connector remover plate 316BA having at least two third sharpener shaft connector remover spikes 316BB positioned round a periphery extending upwardly therefrom. The third sharpener shaft connector remover 316B functions to remove a broken plastic dart shaft connector from a dart head. There are at least two third sharpener shaft connector remover spikes 316BB recessed within the third sharpener 316 permitting the third sharpener 316 to be inserted into a user's pocket without incurring a prick from the at least two third sharpener shaft connector remover spikes 316BB.

The foregoing description can be found in my pending application Ser. No. 481,244, filed Jan. 11, 2000, which is a continuation of my application Ser. No. 291,442, filed Apr. 13, 1999, which is a continuation-in-part of my application Ser. No. 837,542, filed Apr. 21, 1997, now U.S. Pat. No. 5,921,874, issued Jul. 13, 1999, the disclosures of which are incorporated by reference herein and made part of this disclosure.

Figure 10:
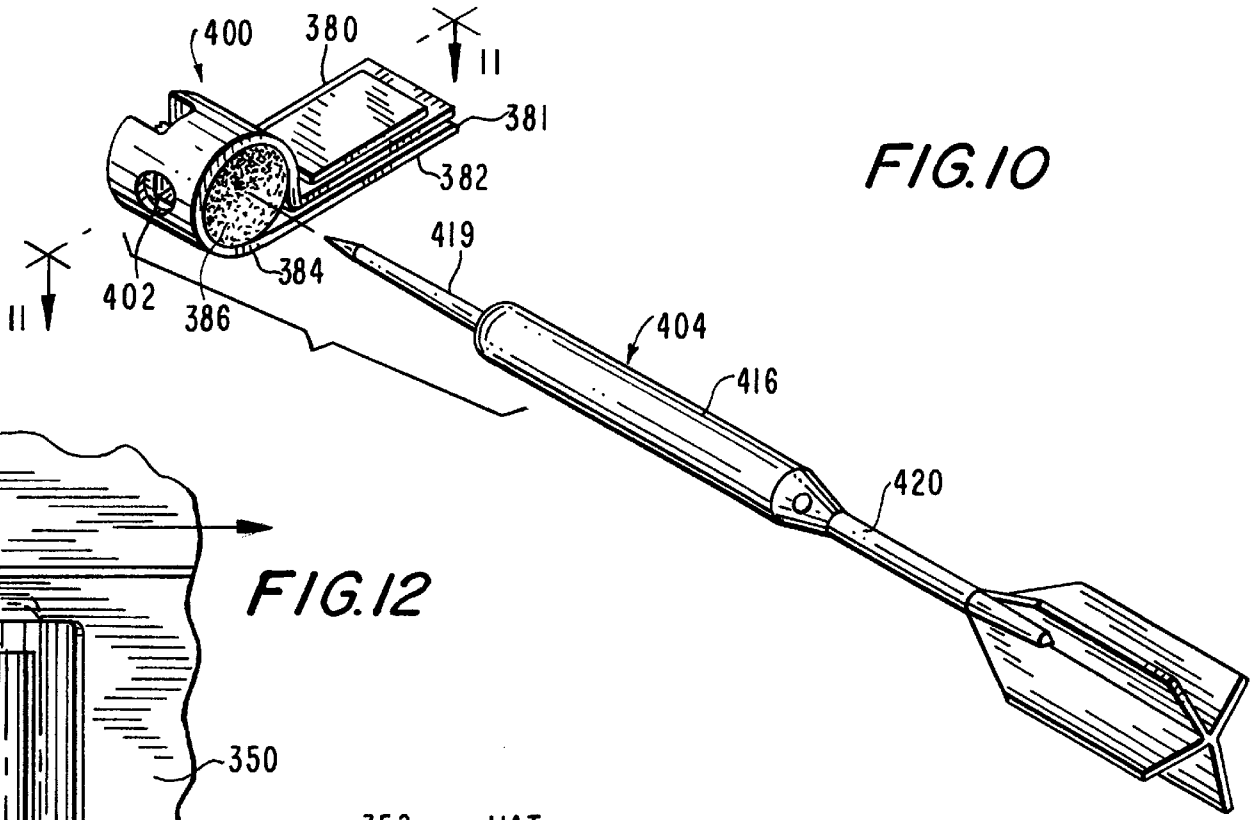
FIG. 10 a right side perspective view from above, of the dart tool constructed according to the invention illustrating an exemplary dart positioned to be inserted into the point sharpener of the tool.
Figure 11:
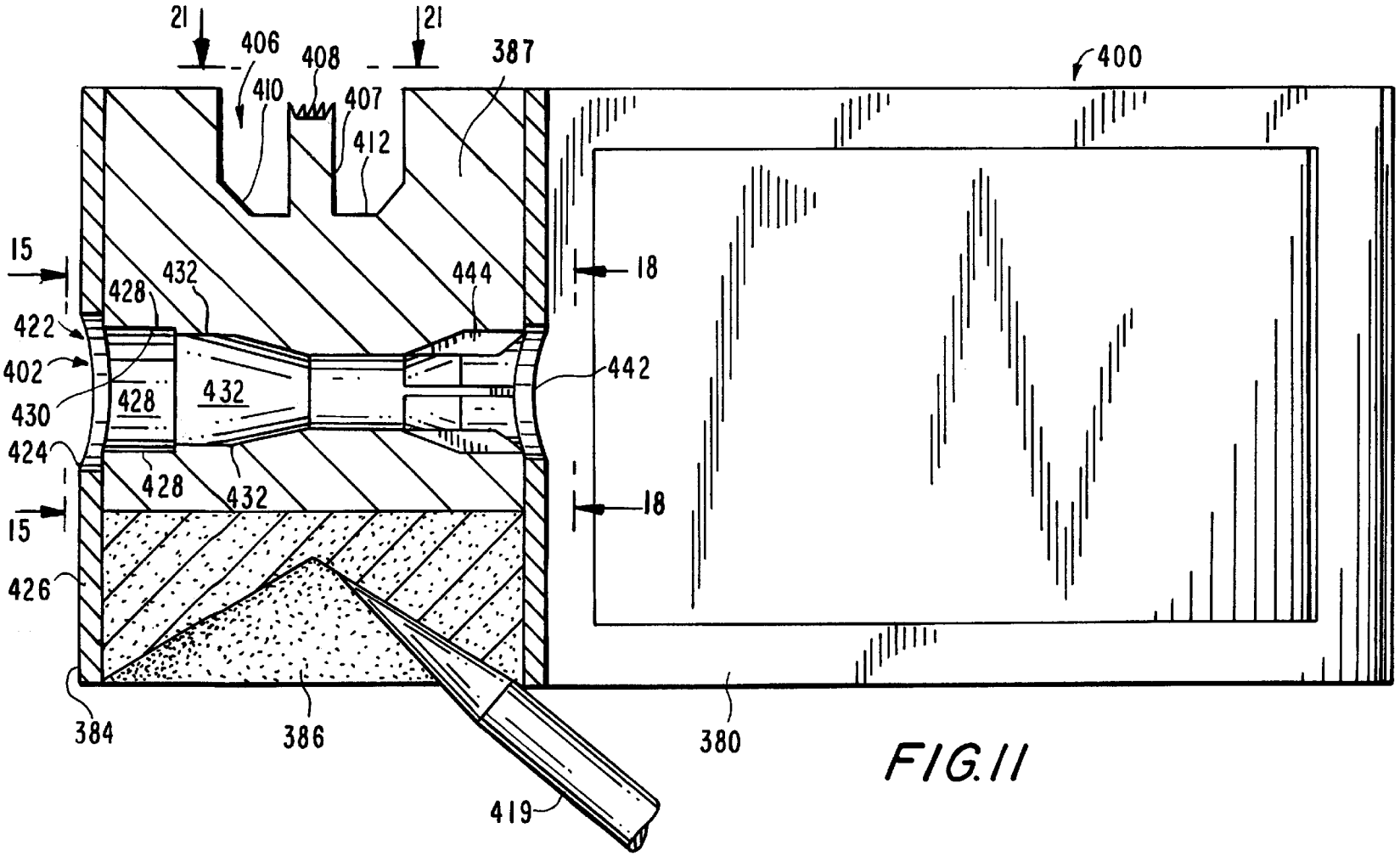
FIG. 11 is a cross-sectional view taken along lines 11—11 of FIG. 10, illustrating the multi-functional features of the dart tool of FIG. 10.

Referring to FIGS. 10 and 11 there is shown a dart tool 400 which is an alternative embodiment of the dart tool shown in the previous Figs. Plastic dart tip remover device 402 is combined in the tool 400. FIG. 10 shows an exemplary dart 404 with tip 419 in preparation for sharpening in the sharpening device of the tool 400. The alternative embodiment 400 includes flight straightener 380 top and flight straightener bottom 382 positioned generally parallel to each other for reception of a flight therebetween. The flight straighteners are connected to a housing 384 that is cylindrical in shape and is at least partially filled with a solid support material 387, preferably metal for strength. The flight straighteners preferably have a square profile shape along the peripheral edge as shown at 381 in FIG. 10. Alternatively, the profile shape of the peripheral edge may be sharpened, not sharpened, or rounded.

A dart tip sharpener 386 is preferably made from a sharpening stone material and is positioned adjacent the metal support section 387 inserted into the opposite side of housing 384 as best shown in FIG. 11. FIG. 11 shows a shaft removing device 406 with a post 407 having a plurality of points 408 on the end of the shaft remover 406. The post 407 is preferably positioned in the center of a semi-circular channel 410 extending vertically from the top to the bottom of the housing 384. The channel 410 is such a depth and width so that it securely holds a dart shaft in place when the dart shaft is being removed. In another alternative embodiment as shown in FIG. 25, a non-marking material such as plastic coating 422 may be attached to the surface of the semi-circular channel in the housing so as to provide a surface that does not damage the dart shaft. The non-marking material may be made of plastic, rubber, nylon, cloth or leather.

FIG. 21 shows the spikes 408 on the post 407. The spikes 408 generally point in a direction away from the base 412 of the shaft removal device 406. Preferably, spikes 408 are positioned along the periphery of the free end of post 407. Alternatively, they may be positioned over the entire upper surface of the free end of post 407.

FIG. 22 shows one preferred embodiment of the spikes 408 on the post 407. The spikes 408 on the post 407 are preferably slanted at an acute angle in a rightward direction as shown to facilitate effective removal by unthreading of the broken portions of the dart shafts or tips with the shaft removal device 406. This slanting of spikes 408 is made possible by the fact that the tool is intended only for unthreading of a broken tip or shaft, and not for threading of such broken piece. The direction of slant of spikes 408 should be opposite the direction of threading of the shaft so that the spikes may penetrate and grip the broken piece to unthread it from the dart head. Thereafter, the broken portion of the dart shaft will be removed by turning the dart head in the unthreading direction to engage the points of the dart shaft removal device 406 with the broken portion of the dart shaft as shown. The angled configuration of the spikes 408 facilitates better engagement and gripping of the broken dart shaft for rotation since the slanted orientation of the spikes actually causes an inward force provided by a user to have a rotational force component which enhances the user provided torque to remove the broken piece. As noted, spikes 408 can be included in various arrangements, i.e., over the entire upper surface of post 407 or around the peripheral edge.

FIG. 23 shows the broken shaft remover device 406 engaging the broken portion of the dart shaft 414 that is broken at the level of the dart head 416.

Alternatively, FIG. 24 shows the dart shaft removal device 406 as it may be used in the same manner to remove broken portions of plastic dart tips 420 broken at the level of the dart head 416.

The number of spikes 408 to grip the broken shaft 414 is not limited to any particular number, nor only to the peripheral edge of the post 407. Multiple rows of such spikes 408 may be positioned around the periphery of the post 407 as shown, and may also be distributed over the entire surface of the free end of post 407 to provide increased engagement of the broken shaft 414, with improved gripping action.

FIG. 25 shows the post 407 of dart shaft removal device inserted into an aperture 418 extending through a dart shaft 420 made of metal. To use the dart shaft removal device for a metal shaft, the dart removal device is inserted into the aperture 418 of the shaft 420 so that the shaft 420 is held securely in place and the dart head 416 can then be unscrewed in a counterclockwise direction to unthread the dart head 416 from the dart shaft 420.

Referring again to FIG. 11, the dart tool combines a wrench device 402 for removing a replaceable dart tip from the dart head. Since plastic dart tips on certain darts need to be removed from time to time, the tips are configured to have an outer surface profile made for engaged mating reception within the wrench device 402. The outer surface of the tip may include multiple flats or dimpled recesses for engaged relation with the wrench device 402, such that upon engagement, the wrench device may be turned to unscrew the dart tip from the dart head, or alternatively, the wrench device may be held fixed while the dart head is rotated in the unthreading direction.

The preferred embodiment of the present invention is shown in FIG. 11. Metal insert 387 is proportioned within housing 384 on one side thereof and dart tip sharpener 386 is positioned on the other side as shown, opposite the metal insert. Housing 384 includes a first aperture 422 which communicates with a first wrench-type device 428, 432 defined by metal insert 387. On the opposite side of housing 384, aperture 442 communicates with a second wrench-type device in the form of a star wrench 444, defined within metal insert 387. Apertures 422 and 442 are of sufficient dimension and shape to accommodate entry of a dart head for entry into the respective wrench-type device.

Figure 15:
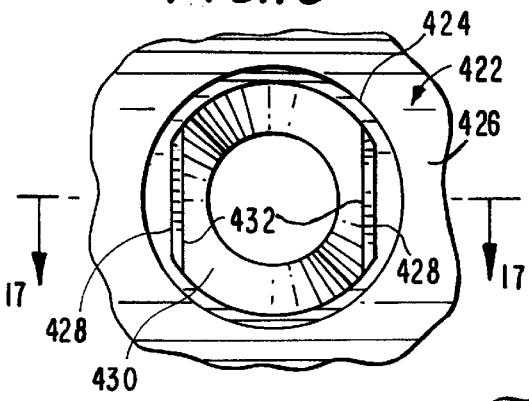
FIG. 15 is a rear elevational view of the dart tool of the invention, illustrating a multi-sized wrench-type dart tip removing device.

In FIG. 11, wrench-type device 428, 432 includes two distinct wrench sections, as shown, to receive and rotate dart heads of respective different dimensions. The first wrench device 428 includes two parallel walls 428 as shown in FIG. 15 to accommodate reception of corresponding flat surfaces on a dart tip portion therebetween. Positioned inwardly of walls 428 are two parallel walls 432 which are spaced closer together from walls 428 to accommodate correspondingly dimensioned flat surfaces on the tip portion of a smaller dart. In operation, dart tips of two distinct sizes may be inserted into aperture 422 and gripped between the respective walls 428, 432 for rotational removal from respective heads.

Figure 18:
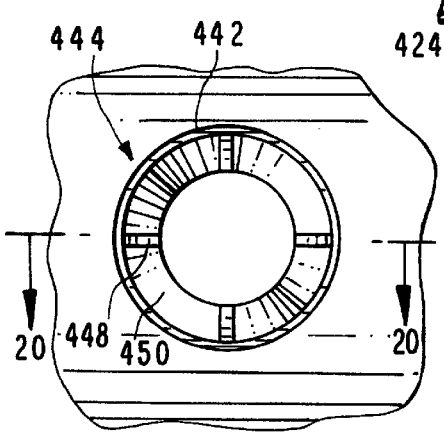
FIG. 18 is a front elevational view of the dart tool of FIG. 10, illustrating an alternative embodiment of the star-type dart tip removing device.

Referring again to FIG. 11, aperture 442 communicates with star-shaped wrench 444 defined by metal insert 387. Star-type wrench 444 is best shown in FIG. 18 and includes axial opening 450 having a plurality of radial fins 448 extending inwardly thereof and dimensioned and configured for entry into correspondingly positioned and dimensioned slots on the outer surface of a dart tip. Thus, when a dart tip is inserted into aperture 442, and made to be aligned for entry of fins 448 into the slots thereon, the dart tip will be gripped for manual threaded removal from the head of the dart.

The preferred embodiment of the present invention is shown in FIG. 11 FIG. 15 shows a rear view of a wrench type device 422 having an aperture 424 on one side of the housing 426 that is slightly larger than the circumference of the dart head 416 so as to permit entry therein. The aperture 424 extends through the wall of the housing 426 and is configured in such a way as to receive a dart tip for entry into wrench-type device 428.

Figure 16:
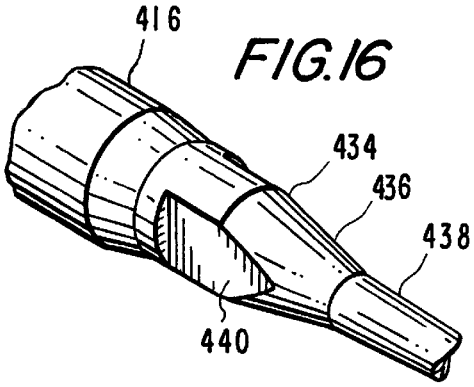
FIG. 16 is a left side perspective view from above of an exemplary wrench shaped plastic dart tip.

FIG. 16 shows an exemplary partial perspective view of a dart tip 434 contemplated for use with the wrench-type tool of the present invention. The wrench type dart tip 434 has a conical shape 436 that decreases in diameter approaching the distal pointed tip 438. On the sides of the dart tip 434 there are two parallel flat sections 440 which form the wrench-type surfaces. The dart tip 434 is shown fully screwed into the dart head 416.

Figure 17:
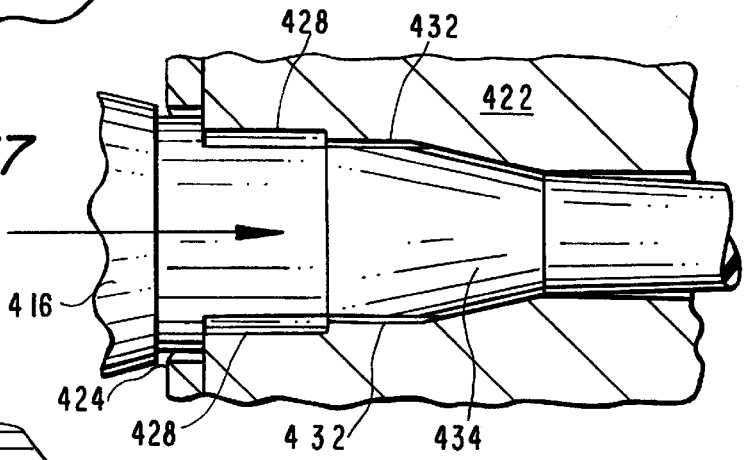
FIG. 17 is a cross-sectional view of the rear portion of the dart tool shown in FIG. 11, taken along lines 17—17 of FIG. 15, illustrating the wrench-type dart tip removing device of FIG. 15, with a representative smaller sized dart positioned therein for tip removing purposes.

FIG. 17 shows a smaller dart tip 434 in the wrench type dart tip remover device 422. The dart tip 434 is shown in engagement with the smaller parallel walls 432 inside the wrench-type removal device 422.

Since dart tips generally have two types of outer surfaces, namely a wrench-type surface with flat parallel surfaces, or a star-type tip, thus two types of removal wrenches are typically required. However, in the present invention the two wrenches are combined into one tool for easy access.

Referring to FIG. 11, the opposite side of the aperture 424 of the wrench tip remover 422 extends completely through housing 384 to the front of the tool 400. The aperture or opening 442 on the front side forms the star type device 444 for removing the star shaped dart point 446. The star opening 442 is only slightly larger than the dart head 416 so as to limit side to side motion of the head but still allow easy insertion and for exiting.

Referring to FIG. 18, a plurality of fins 448 extend out from the inner surface 450 of the star-type wrench 444 to grip the a dart tip point 446. The fins 448 extend outward from the inside surface 450 toward the center of the aperture 442. The length of the fins 448 is such that a dart tip 446 may engage the points on the outer recesses 452 in the dart tip 446. The fins 448 are such that both the larger and smaller star shaped dart tips 446 can be removed using the star wrench 444. In the preferred embodiment, there are four fins 448 spaced equally apart from each other in the aperture 442.

Figure 19:
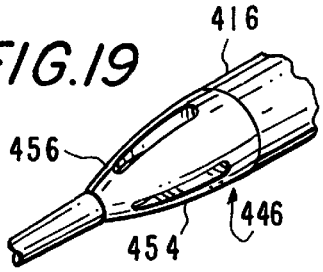
FIG. 19 is a right side perspective view from above, of an exemplary star shaped plastic dart tip.

FIG. 19 shows an exemplary partial perspective view of the star-type dart tip 446. The star-type dart tip 446 has a plurality of recesses 454 on the surface 456 of the dart to engage a corresponding number of fins 448 in the star-type wrench device 444. The dart tip 446 is shown as being fully screwed into the dart head 416.

Figure 20:
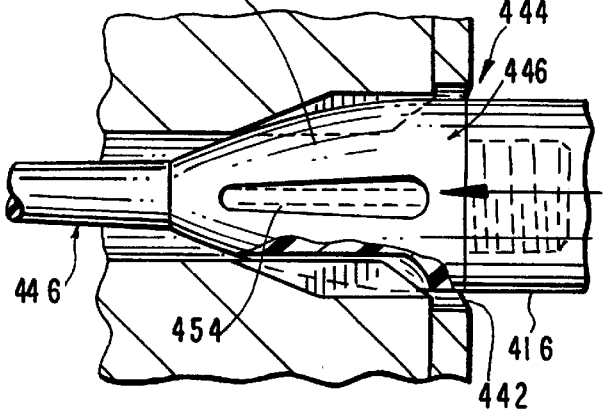
FIG. 20 is a cross-sectional view of the front portion of the dart tool shown in FIG. 11, taken along lines 20—20 of FIG. 18, illustrating the star type dart tip removing device of FIG. 17 with a representative dart positioned therein for tip removal purposes.

FIG. 20 shows the star-type wrench 444 engaging a star-type dart tip 446. The fins 448 are shown to extend into the recesses 454 in the surface of the dart tip 446. The dart tip 446 is now held securely in place so that the dart head 416 may be unscrewed from the dart tip 446.

It will be understood that each of the elements described above, or two or more together, may also find a useful application in other types of constructions differing from the type described above.

Without further analysis, the foregoing will so fully reveal the gist of the present invention that others can, by applying current knowledge, readily adapt it for various applications without omitting features that, from the standpoint of prior art, fairly constitute essential characteristics of the generic or specific of this invention.

While the invention has been illustrated and described as embodied in a dart tool it is not intended to be limited to the details shown, since it will be understood that various omissions, modifications, substitutions and changes in the forms and details of the device illustrated and in its operation can be made by those skilled in the art without departing in any way from the spirit of the present invention as described and defined by the following claims.

What is claimed is:

1. A dart tool for maintaining projectile-type darts, the darts each having a head portion, a tip portion, and a shaft portion, the shaft portion having flight stabilizing devices supported thereon to form a flight, which comprises:

a) housing;

b) flight straightener attached to said housing, said flight straightener comprising a top and a bottom, each having a flat surface and a peripheral edge and being movable toward each other by a user while a dart flight is positioned between said top and bottom, whereby relative sliding motion between said top and bottom and the dart flight causes the surfaces of the flight to be smoothed and/or material to be scraped therefrom; and c) at least one wrench-type device for threadedly removing at least the tip portion from the head portion.

2. The dart tool according to claim 1, wherein said housing is generally cylindrical.

3. The dart tool according to claim 1, wherein each said peripheral edge of said top and bottom has a profile shape selected from a group consisting of not sharpened, sharpened, rounded, and square.

4. The dart tool according to claim 3, wherein said peripheral edges are rounded to prevent damage to said flights during use.

5. The dart tool according to claim 3, wherein said peripheral edges are square.

6. The dart tool according to claim 1 further comprising an abrasive tip portion sharpener secured in said housing.

7. The dart tool according to claim 6, wherein said sharpener defines an opening or reception of the end of the tip portion for sharpening purpose.

8. The dart tool according to claim 6, wherein said sharpener is comprised of a material selected from a group consisting of stone, diamond cutting material, cubic zirconium, stone composites and composites.

9. The dart tool according to claim 1, wherein said housing and said flight straightener are constructed from a material selected from a group consisting of metal, metal alloy, plastic, plastic composite, epoxy, fiber glass, and carbon-graphite.

10. The dart tool according to claim 9, wherein said wrench-type device further comprises, a) a generally circular first housing aperture in said housing, b) an insert positioned in said housing, and having a generally circular first insert aperture, said aperture in said housing and said aperture in said insert being aligned with one another; and c) a plurality of extensions extending generally radially inwardly from the inner surface of said insert aperture, said extensions being dimensioned and positioned for corresponding reception by a dart tip, such that when the dart tip portion is inserted into said wrench-type device, the dart tip portion will be rotationally fixed so as to permit removal of the dart tip portion from the dart head.

11. The dart tool according to claim 10, wherein said housing has a second generally circular housing aperture on a side opposite said first insert aperture and said insert comprises a second insert aperture on a side generally opposite said generally circular first insert aperture, said second insert aperture being aligned with said second housing aperture, and including at least two substantially parallel flat surfaces therein positioned and dimensioned to form a dart wrench adapted to be positioned in face-to-face relation with corresponding flat surfaces of a dart tip when the dart tip is inserted into said second housing and insert apertures.

12. The dart tool according to claim 11, wherein said insert defines a third insert aperture positioned adjacent and inward of said second insert aperture, said third insert aperture having a dimension less than said second insert aperture to receive dart tips of lesser dimension, said third insert aperture having therein at least two parallel surfaces therein dimensioned to be positioned in face-to-face relation with corresponding parallel surfaces on a dart tip to form a rotational wrench to facilitate removal of the dart tip portion from the dart head portion when the dart tip is inserted into said third insert aperture through said second insert aperture.

13. A dart tool for maintaining projectile-type darts, the darts each having a head portion having two ends, a tip portion threadedly attached to one end of the head portion, and a shaft portion threadedly attached to the other end of the head portion, the shaft having flight stabilizing devices supported thereon, which comprises:

a) housing;

b) flight straightener attached to said housing, said flight straightener comprising a top member and a bottom member, said members having respectively opposed flat surfaces and peripheral edges and being movable toward each other by a user while a dart flight is positioned between said top and bottom members, whereby relative sliding motion between said top and bottom members and the dart flight causes sliding engagement between said flat surfaces and the dart flight such that the surfaces of the flight are smoothed and/or material scraped therefrom;

c) an insert positioned within said housing;

d) at least a first wrench device defined by said insert for threadedly removing a wrench-type tip portion from the head portion, said first wrench-type device comprising a first generally circular aperture which includes at least two spaced parallel surfaces for face-to-face relation with correspondingly positioned parallel surfaces on a dart tip when the dart tip is inserted into said first wrench device; and e) at least a second star-type wrench device defined by said insert for threadedly removing a star-type tip portion from the head portion, wherein said star-type wrench device comprises a second generally circular aperture in said insert, and a plurality of extensions extending generally radially inwardly from an inner peripheral surface of said second aperture, said extensions being dimensioned and positioned for entry into correspondingly dimensioned and positioned apertures in a tip portion of a dart, such that when the dart tip portion is inserted into said star-type wrench device, said extensions enter the apertures in the dart tip portion so as to be rotationally engaged for threaded removal of the dart tip from the dart head.

14. The dart tool according to claim 14, further comprising a third wrench-type device positioned inward and adjacent said first wrench-type device and defining a third generally circular aperture of lesser dimension than the dimension of said first wrench-type device for reception of a dart tip portion of lesser dimension through said first wrench-type device, said third generally circular aperture including at least two spaced parallel surface portions positioned for face-to-face relation with correspondingly positioned parallel surface portions on the dart tip portion to prevent rotation of a dart tip portion positioned therein for removal from the dart head portion.

15. A dart tool for maintaining projectile-type darts, the darts each having a head portion, a tip portion threadedly attached to a first end of the head portion, and a shaft portion threadedly attached to the second end of the head portion, the shaft portion having flight stablilizing devices supported thereon to form a flight, which comprises:

a) a generally cylindrical shaped housing;

b) flight straightener attached to said housing, said flight straightener comprising a top member and a bottom member having opposed flat surfaces and respective opposed peripheral edge and being movable toward and away from each other by a user while a dart flight is positioned between said opposed flat surfaces of said top member and said bottom member, whereby relative sliding motion between said top and bottom members and the dart flight causes sliding engagement between said opposed surfaces and the surfaces of the flight whereby the surfaces of the flight are smoothed and/or material scraped therefrom;

c) a first wrench-type device for threadedly removing a wrench-type tip portion of a dart from the head portion;

d) a second star-type wrench device for threadedly removing a star-type tip portion of a dart from the head portion;

e) a dart shaft removal device structured to tighten or loosen a dart shaft threadedly attached to the head portion and to remove broken portions of a dart shaft or dart tip threadedly attached to the dart head; and f) an abrasive tip portion sharpener secured in said housing.

16. The dart tool according to claim 15, wherein said dart shaft removal device comprises a dart shaft holder by which a dart shaft is held in place while a user tightens or loosens a dart head with respect thereto.

17. The dart tool according to claim 16, wherein said dart shaft removal device comprises a channel in said housing to cradle a dart shaft, and a post securely attached within said channel and extending generally radially outward therefrom whereby said post may be positioned in an aperture in a dart shaft to hold the dart shaft in a fixed position while the user threadedly tightens or loosens the dart head.

18. The dart tool according to claim 17, wherein a plurality of sharp spikes protrude outwardly from a free end of said post, said spikes being configured for gripping a broken dart tip portion.

19. The dart tool according to claim 18, wherein said plurality of sharp spikes are positioned along a peripheral edge of said free end of said post.

20. The dart tool according to claim 19, wherein said plurality of sharp spikes are oriented at an angle with respect to an upper surface of said free end of said post.

21. The dart tool according to claim 20, wherein said sharp spikes are oriented at an acute angle with respect to said upper surface of said free end of said post for gripping a broken dart shaft or tip, the direction of slant of said spikes being opposite the direction of threading of said dart shaft or tip with respect to said dart head.

22. The dart tool according to claim 18, wherein said sharp spikes are positioned over the entire surface of said free end of said post.

23. The dart tool according to claim 21, wherein said dart shaft holder further comprises a non-abrasive coating in said channel in said housing to prevent damage to the dart shaft portion.

24. The dart tool according to claim 23, wherein said non-abrasive coating is comprised of a material selected from a group consisting of plastic, leather, rubber, nylon and fabric cloth.

25. A dart tool for maintaining projectile-type darts, each having a head portion having two ends, a tip portion threadedly attached to one end of the head portion, and a shaft portion threadedly attached to the other end of the head portion, the shaft portion having generally planer flight stabilizing devices supported thereon to form a flight which comprises:

a) a housing having a generally cylindrical configuration;

b) flight straightener attached to said housing, said flight straightener including an upper member and a lower member, each said member having a flat surface facing the correspondingly opposed flat surface of said other member, said members being movable toward and away from each other by a user while a dart flight is positioned therebetween, whereby relative sliding motion between said upper and lower members and the dart flight causes sliding engagement between said opposed flat surfaces and the surfaces of the flight so as to smooth the surfaces of the flight and/or scrape material therefrom;

c) an insert member securely positioned in one side of said housing, said insert member comprising:

i) a first wrench-type device including an aperture dimensioned and configured for reception of a dart tip portion having at least two opposed parallel outer surfaces, said aperture defining at least two parallel opposed flat surfaces which oppose the flat surfaces of the dart tip portion to restrain the dart tip portion from rotation to permit threadedly removing or tightening of the dart tip portion with respect to the head portion;

ii) a second wrench-type device on a side of said insert opposite said first wrench-type device, said second wrench-type device including an aperture dimensioned and configured for reception of a star-type tip portion of a dart, said aperture including a plurality of radially inwardly extending members dimensioned, spaced and configured for reception by a plurality of correspondingly shaped and spaced apertures in the dart tip when the dart tip portion is inserted therein to restrain the dart tip portion from rotation to permit threadedly removing or tightening of the dart tip portion with respect to the head portion;

iii) a third wrench-type device positioned adjacent said first wrench-type device and inwardly thereof and defining an aperture of lesser dimension than said first wrench-type device for reception of a dart tip portion of correspondingly lesser dimension through said first wrench-type device, said third aperture including at least two opposed parallel surfaces positioned for reception of a dart tip portion having correspondingly positioned and dimensioned opposed parallel surfaces to restrain the dart tip portion from rotation for threaded removal or tightening with respect to the dart head portion; and d) a dart tip portion sharpening device supported by said housing adjacent said insert, said sharpening device being made of an abrasive tip sharpening material selected from a group consisting of stone, diamond cutting material, cubic zirconium, stone composites and composites, and defining a surface for reception of a tip portion of a dart for sharpening the tip portion.

* * * * *